US008011376B2

(12) United States Patent
Parker

(10) Patent No.: US 8,011,376 B2
(45) Date of Patent: Sep. 6, 2011

(54) COSMETICS CASE WITH APPLICATOR HOLDER

(75) Inventor: Phillipe Parker, St. Julians (MT)

(73) Assignee: Toly Products (UK) Ltd. (GB)

( * ) Notice: Subject to any disclaimer, the term of this patent is extended or adjusted under 35 U.S.C. 154(b) by 513 days.

(21) Appl. No.: 12/096,192

(22) PCT Filed: Dec. 4, 2006

(86) PCT No.: PCT/GB2006/004528

§ 371 (c)(1),
(2), (4) Date: Jun. 5, 2008

(87) PCT Pub. No.: WO2007/066086

PCT Pub. Date: Jun. 14, 2007

(65) Prior Publication Data

US 2008/0302384 A1 Dec. 11, 2008

(30) Foreign Application Priority Data

Dec. 5, 2005 (GB) ..... 0524781.2
Jan. 20, 2006 (GB) ..... 0601193.6

(51) Int. Cl.
*A45D 33/24* (2006.01)

(52) U.S. Cl. ..... 132/294; 206/581; 206/823; 206/751

(58) Field of Classification Search ..... 132/291, 132/293, 294, 295, 297, 317; 206/581, 823, 206/751, 765, 754

See application file for complete search history.

(56) References Cited

U.S. PATENT DOCUMENTS

| | | | | |
|---|---|---|---|---|
| 1,540,349 | A | 6/1925 | Loesser | |
| 5,107,984 | A * | 4/1992 | Welschoff | 206/751 |
| 6,237,612 | B1 | 5/2001 | Heyer | |
| 6,398,027 | B1 * | 6/2002 | Ryu | 206/362 |
| 6,547,074 | B1 * | 4/2003 | Chen | 206/379 |
| 2002/0162567 | A1 | 11/2002 | Jang | |
| 2005/0056559 | A1 * | 3/2005 | Chen | 206/372 |
| 2005/0161356 | A1 | 7/2005 | Chen | |

FOREIGN PATENT DOCUMENTS

| | | |
|---|---|---|
| FR | 903.706 | 10/1945 |
| GB | 416401 | 5/1934 |
| JP | 10-243814 | 9/1998 |

OTHER PUBLICATIONS

Search Report dated May 15, 2006 in related Application No. GB0601193.6.

International Search Report and Written Opinion dated Mar. 8, 2007 in related Application No. PCT/GB2006/004528.

* cited by examiner

*Primary Examiner* — Rachel R Steitz

(74) *Attorney, Agent, or Firm* — Kilpatrick Townsend & Stockton LLP

(57) ABSTRACT

The case (1) comprises a lid (2), a base (3) and a holder (7) for a cosmetics applicator; the lid, base and holder being interconnected along a hinge (4). The hinge comprises a boss (5) positioned intermediate its ends and the holder comprises a surface (18) engageable with the boss such that opening the container causes the holder to lift from the base.

9 Claims, 6 Drawing Sheets

COSMETICS CASE WITH APPLICATOR HOLDER

CROSS REFERENCE TO RELATED APPLICATIONS

This application is the U.S. national phase of International Application No. PCT/GB2006/004528 filed on Dec. 4, 2006 and published in English on Jun. 14, 2007 as International Publication No. WO 2007/066086, which application claims priority to Great Britain Application No. 0524781.2 filed on Dec. 5, 2005 and Great Britain Application No. 0601193.6 filed on Jan. 20, 2006, the contents of all of which are incorporated herein by reference.

FIELD OF INVENTION

The invention relates to a cosmetics case containing a cosmetics brush or other applicator. It particularly concerns cosmetics cases and compacts in which the applicator is readily accessible for removal by the user.

BACKGROUND OF THE INVENTION

Conventional cosmetics cases and compacts for application of cosmetic material such as face powder can be cumbersome and inconvenient to use. It can be particularly inconvenient and awkward when the user has to extract an applicator from within a recess in the cosmetic case. A cosmetic case in which the applicator more readily presents itself to the user for extraction is desired.

U.S. Pat. No. 6,398,027 describes a case containing a number of cosmetic brushes. The brushes are disposed in holders pivotally arranged side by side along a hinge pin. The body of each brush holder has an arc shaped guide groove for receiving a protrusion extending from an immediately neighbouring brush holder. Similar protrusions and guide groves connect the endmost brush holders to side walls of the lid and base respectively. Opening of the case by rotating the lid about the hinge pin causes the protrusion at the lid side wall to move along its guide groove. When the movement of the protrusion has reached the end of the guide groove further rotation of the lid causes the associated endmost holder to lift and pivot upwards. This is repeated for the other brush holders in series along the hinge pin. When the case is fully opened the brushes therefore spread out in a fan shape. With this arrangement, it is imperative that the endmost brush holders are adjacent and connected to the side walls of the lid and base respectively, with each holder connected to its neighbour(s), to provide the required leverage and support to all the brush holders in the series. To achieve the full spread of the brush holders it is necessary to fully open the lid. This arrangement is not readily adaptable for operation of fewer brush holders, or to eliminate the mechanical interconnections between neighbouring holders or between the endmost holders and the base/lid sidewalls. This limits design freedom. For example, it may be desirable to separate the brush holders from the side edges of the case to provide space for a powder container, mirror or the like. In the case of a powder compact, only a single brush holder may be necessary. The cosmetic brush container of U.S. Pat. No. 6,398,027 cannot meet these requirements.

In addition, the protrusions extending from the brush holders of U.S. Pat. No. 6,398,027 are preferably made of metal. A protrusion made from the same material as the rest of the brush holder body, i.e. plastic, would be more susceptible to breakage. Providing the brush holder with a metal pin in by insert moulding requires an additional process step.

JP10-243814 shows a cosmetic compact with a hinged outer lid. A lever is fixed to the outer lid near its hinge line and extends above the top surface of a base tray or godet. Opening the outer lid causes the lever to open an inner lid, to uncover a volatile cosmetics product in the base tray.

The present applicant has devised a cosmetics applicator holder actuation mechanism which is more readily adaptable to different applicator and container configurations, which is easier to manufacture and which is neat and unobtrusive in appearance.

SUMMARY OF THE INVENTION

The present invention provides a cosmetics container as defined in claim 1.

In one embodiment, the lift mechanism comprises a surface on the holder.

The boss may be attached to the lid. The boss may define a surface contactable with the surface of the holder.

In a further embodiment, the boss comprises a stop engageable with the surface on the holder.

In a yet further embodiment, the lift mechanism further comprises a lever that operatively engages the holder.

The boss may lie in the base, so that it may be concealed from the compact interior.

Further preferred features and aspects of the invention will be apparent from the dependent claims and the following description of an illustrative embodiment, made with reference to the accompanying drawings.

DETAILED DESCRIPTION OF THE PREFERRED EMBODIMENT

Figure 1:
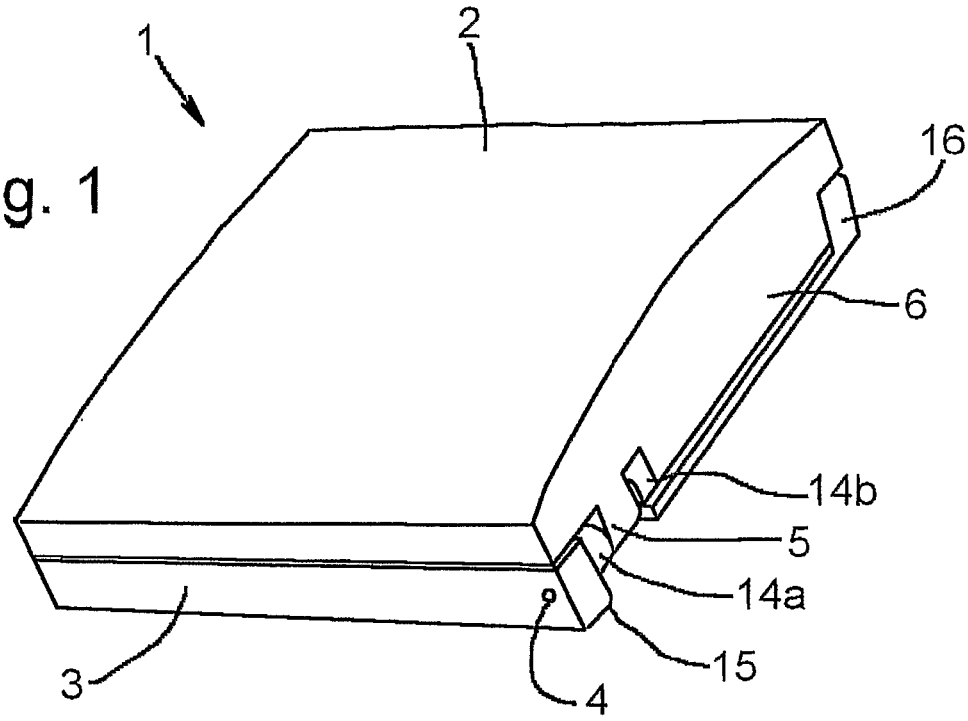
FIG. 1 is a schematic representation of a cosmetic compact, forming a container embodying the invention, shown closed.
Figure 2:
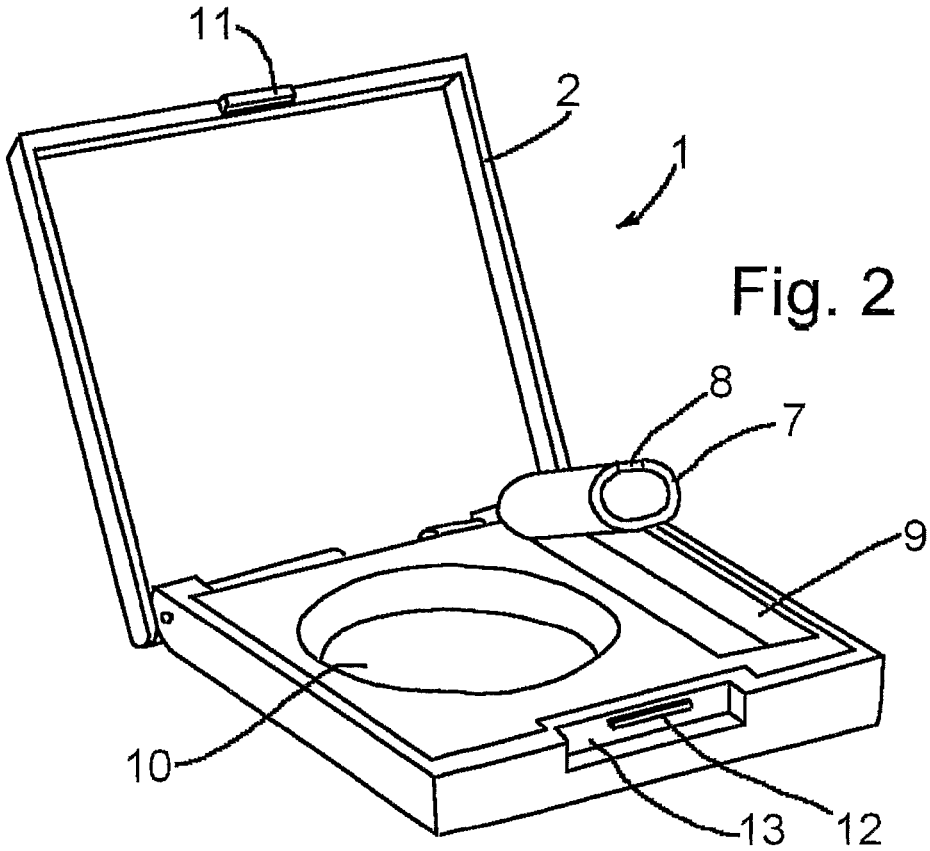
FIG. 2 is a schematic representation of the cosmetic compact when open.

Referring to FIGS. 1 and 2, the cosmetic compact 1 comprises a lid 2 and a base 3 connected along a hinge 4. The hinge 4 comprises two bosses 5 and 6 on the lid which align with co-operating bosses 15 and 16 on the base. A hinge pin 20 (FIG. 3) passes through boss 16 into boss 6. A further, longer hinge pin 22 passes through boss 15 into bosses 5 and 6. In this way the lid is hingedly connected to the base. The cosmetic compact further comprises a holder 7 for holding an applicator such as a cosmetic brush (not shown) and a housing recess 9 in the base 3 for receiving the holder 7 when the compact is closed. The housing recess 9 is elongated longitudinally beyond the length of the holder in order to accommodate the holder and inserted applicator. The holder 7 has a tubular body having a top and bottom wall for receiving the cosmetic tool. The top wall of the holder 7 has a 'T' shaped slot 8 for removably retaining and orienting the applicator in the holder 7. The cosmetic compact also comprises an additional recess 10 in the base 3 for housing cosmetic material such as cosmetic powder. The recess 10 shown is circular but any other suitable shapes can be used, such as square or rectangular. More than one additional recess for housing different cosmetic materials can also be incorporated in the base 3 of the cosmetic compact. Similarly, the housing recess 9 may accommodate more than one holder and applicator, or several such recesses can be provided, for several holders and applicators.

The holder 7 shown in FIG. 2 is lifted or pivoted upwards from its housing recess 9 so that the applicator presents itself to the user when the compact is opened. When closed, the lid 2 and the base 3 are locked together through a locking mechanism 11, 12. The locking mechanism in the illustrated embodiment comprises a tongue 11 with a thickened end snap-engageable over a retaining rib 12 on the base 3, but other conventional types of locking mechanism can be used also. The front wall of the base 3 is formed with a recess 13 around the vicinity of the rib 12 to act as a finger hole for easy access to the locking mechanism.

It is preferable that the lid, the holder and the base are made by injection moulding a polymeric material such as plastic or biodegradable material. Other types of moulding process known in the art can be used, such as casting.

Figure 3:
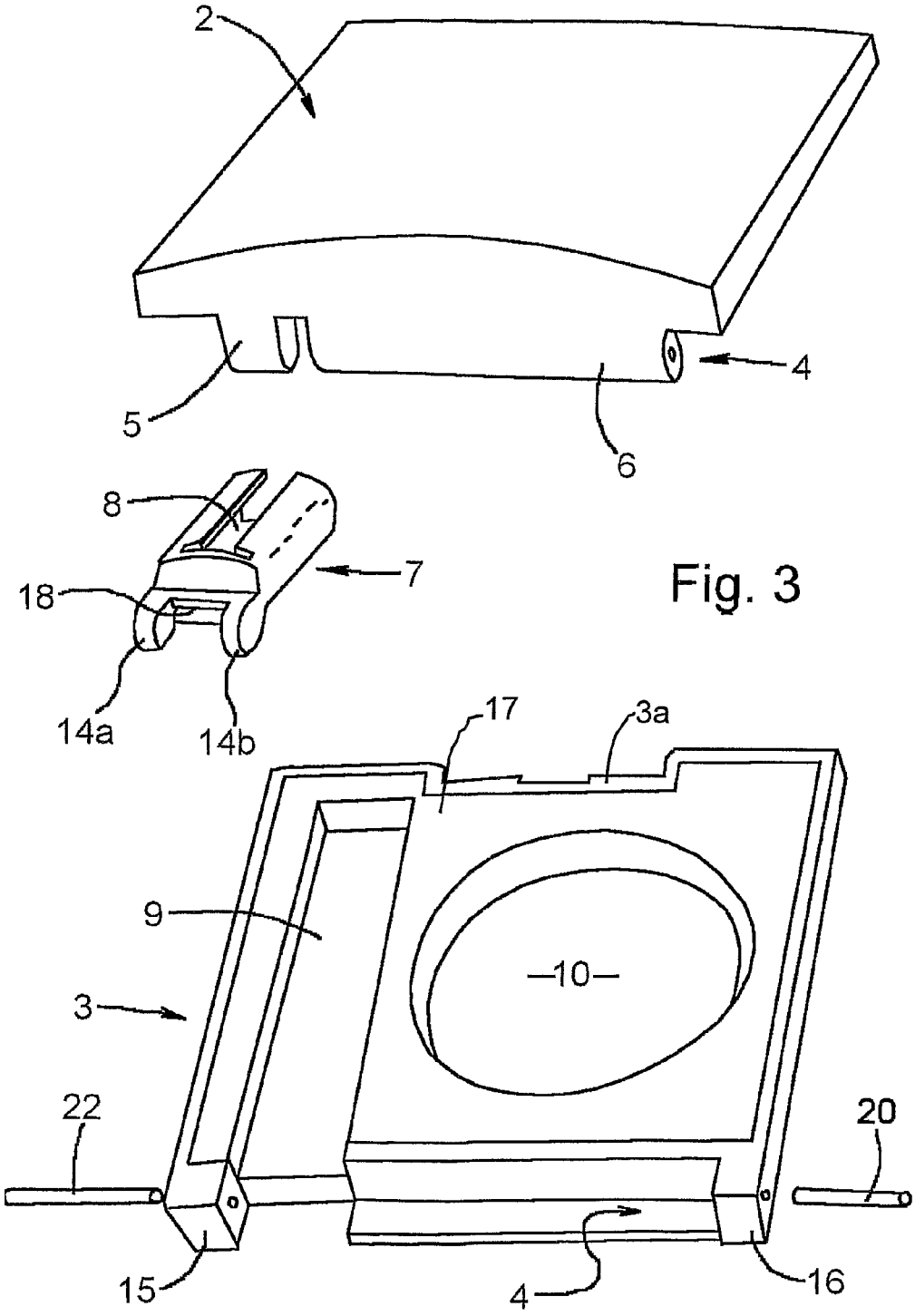
FIG. 3 shows an exploded view of the lid, base and holder of the compact of FIGS. 1 and 2.

Referring now to FIG. 3, the cosmetic compact is shown in exploded perspective. The holder shown from the rear has opposing bosses 14*a*, 14*b* which engage one on either side of the boss 5 on the lid 2. When the compact 1 is assembled, the longer pin 22 is therefore inserted successively through aligned holes in bosses 15, 14*a*, 5, 14*b* and 6 to retain the lid, base and holder pivotally together. The second or shorter hinge pin 20 is positioned at the other end of the hinge 4 through the boss 16 on the base 3 and into the boss 6 on the lid 2. FIG. 1 shows how the bosses 5 and 6 at the rear edge of the lid 2, the bosses 14*a*, 14*b* at the rear of the holder 7 and the bosses 15 and 16 at the rear edge of the base 3 of the cosmetic compact interdigitate when held together by the hinge pins 20 and 22. The hinge pins may be metal roll pins, for example.

Although for economy of material, the illustrated embodiment has two shorter hinge pins received in separate holes at either side of the compact 1 and directed towards the centre without meeting, a single hinge pin running along the entire length of the hinge may be provided instead, or more than one pin may be used at each end of the hinge.

The base 3 shown in FIG. 3 is formed from two parts, a lower part 3*a* and an upper part 17. This saves material compared to a solid base and can be used to produce a high quality exterior finish. A number of different upper parts to suit different compact contents may be provided for use with a common lower part 3*a*. The lower part 3*a* is in form of a tray having opposing walls for receiving the upper part 17. The two parts are held together by snap engagement or bonding by an adhesive, ultrasonic welding, or any other suitable means. Alternatively, the base may be formed as one component.

The boss 6 on the lid has a round outer surface which has the same curvature as the bosses 14*a*, 14*b* on the holder 7 such that they are free to rotate with respect to the base 3. The boss 5 on the lid acts as a camming member interdigitated with the bosses 14*a*, 14*b* on the holder 7. The boss 5 also has a generally curved outer surface but the curvature is interrupted by a step 19 which forms a stop that cooperates with a contact surface on the holder 7 formed by a lip 18. This provides means for lifting the holder 7 so as to pivot about the hinge 4 when the cosmetic compact is opened. This lifting mechanism is further illustrated in FIGS. 4 and 5.

Figure 4:
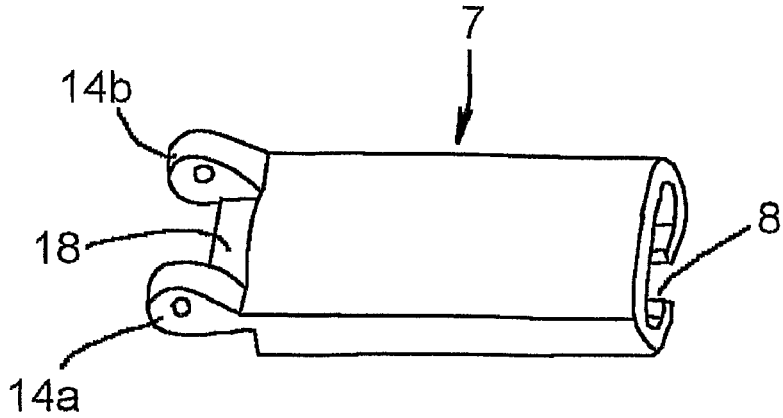
FIG. 4 shows an expanded view of the contact surface on the holder.
Figure 5:
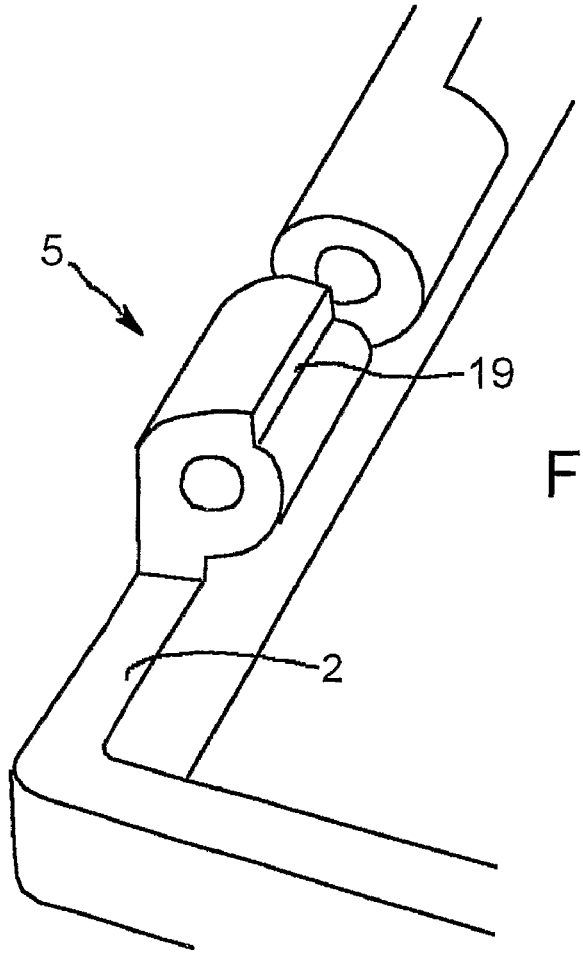
FIG. 5 shows an expanded view of the contact surface on the lid which engages with the holder.

FIGS. 4 and 5 show an expanded view of the base of the holder 7 and the boss 5 on the lid, so to illustrate the lifting mechanism when the cosmetic compact is opened. The lip 18 is shown in between the bosses 14*a*, 14*b* at the base of the holder 7. The lip 18 represents a contact surface which cooperates with the step 19 on the boss 5. In this arrangement the step 19 is shown as having a flat surface which cooperates with the lip 18 on the holder 7. As the cosmetic compact is opened by rotating the lid about the hinge 4, the boss 5 on the lid rotates and the step 19 contacts the lip 18 at the base of the holder. Further rotation of the lid about the hinge 4 causes the holder to lift and pivot about the hinge. Thus the holder and any inserted applicator such as a cosmetic brush lift out of the housing recess 9 and present themselves to the user when the cosmetic case is opened. The boss 5 lies below the top surface of the base 3 upper part or tray 17 and is therefore in the base 3, concealed from the interior of the compact by the tray 17 and holder 7.

Instead of the arrangement shown in FIG. 5, other means for lifting the holder when the cosmetic case is opened can be used within the scope of the present invention. For example, the boss 5 may represent a cam surface which engages with the lip 18 on the holder causing the holder to lift about its hinge when the cosmetic compact is opened. Other examples include providing interengaging gear segments, such that pivotal movement of the lid causes the holder to lift relative to the base, the mechanism again being concealed in the base of the cosmetic case.

The holder can be integrally moulded from a single material and for rising movement does not rely on being adjacent to the side wall of the lid or base at either end of the hinge 4. The advantage of this arrangement is that the holder can be located anywhere intermediate of the ends of the hinge 4 by simply re-locating the boss 5. Where there is more than one holder, a corresponding number of bosses can be provided at appropriate positions along the hinge.

Figure 6:
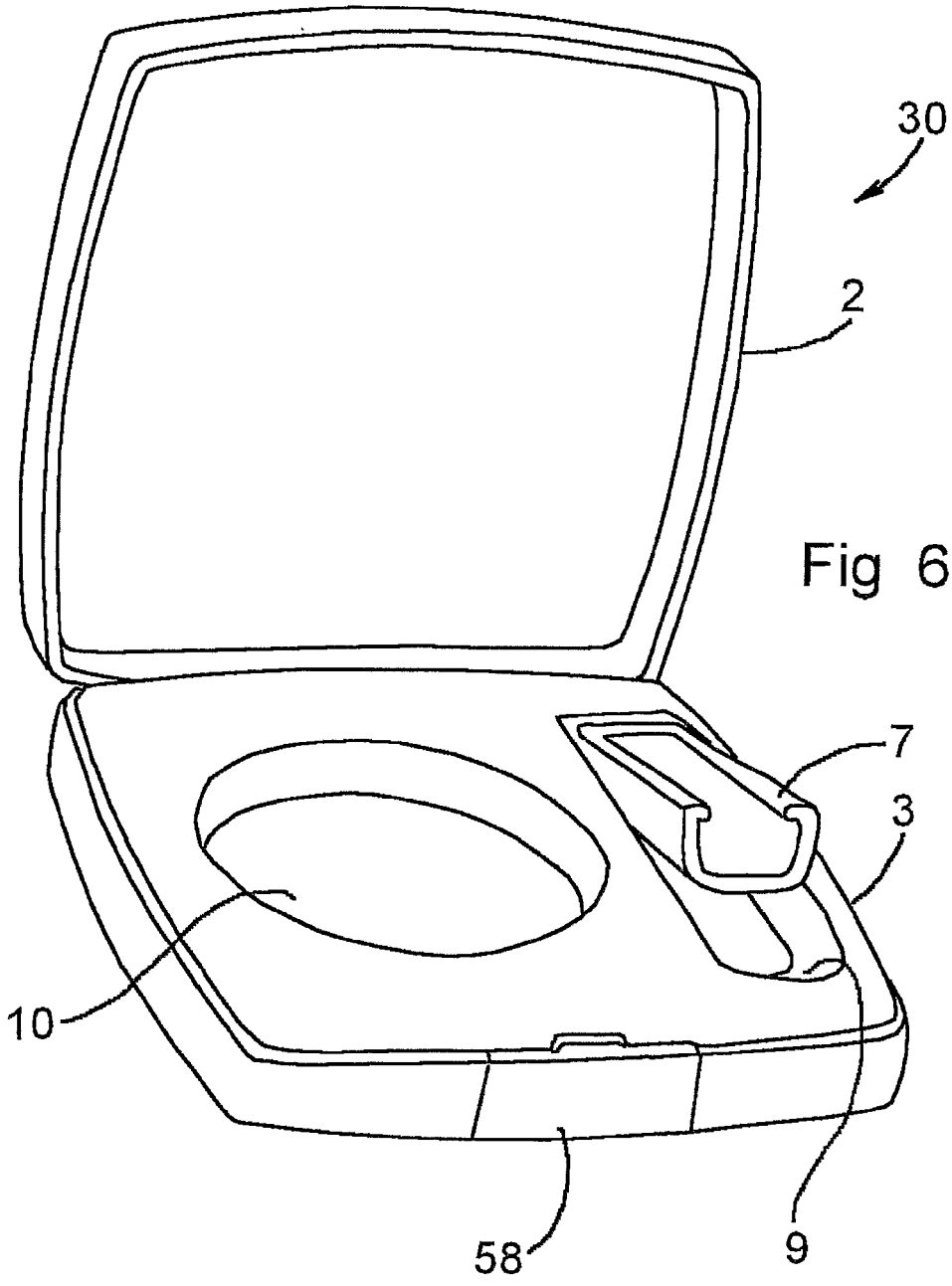
FIG. 6 shows a further compact embodying the invention, with its lid open.
Figure 7:
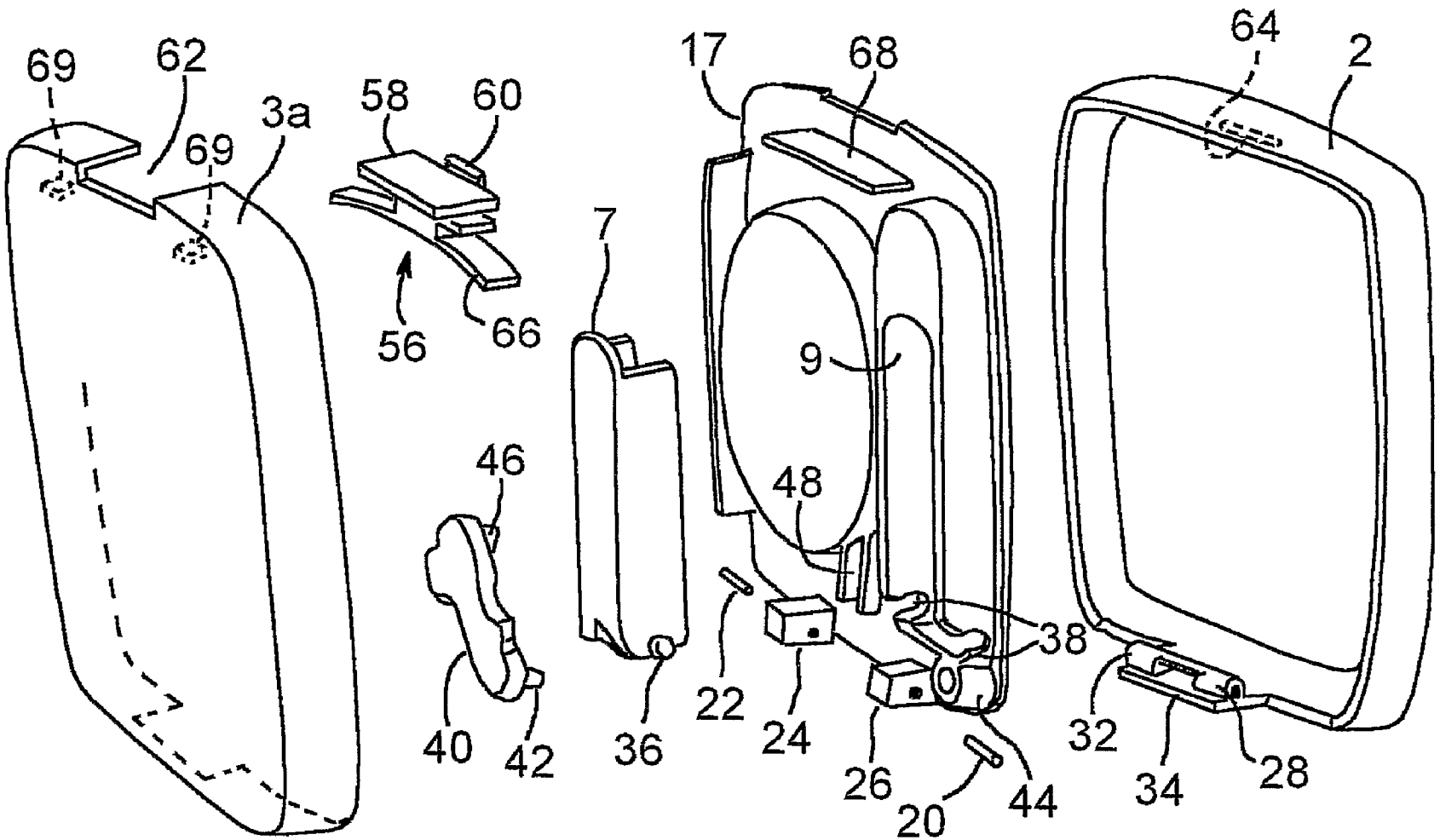
FIG. 7 is an exploded perspective view of components forming the compact of FIG. 6.
Figure 8:
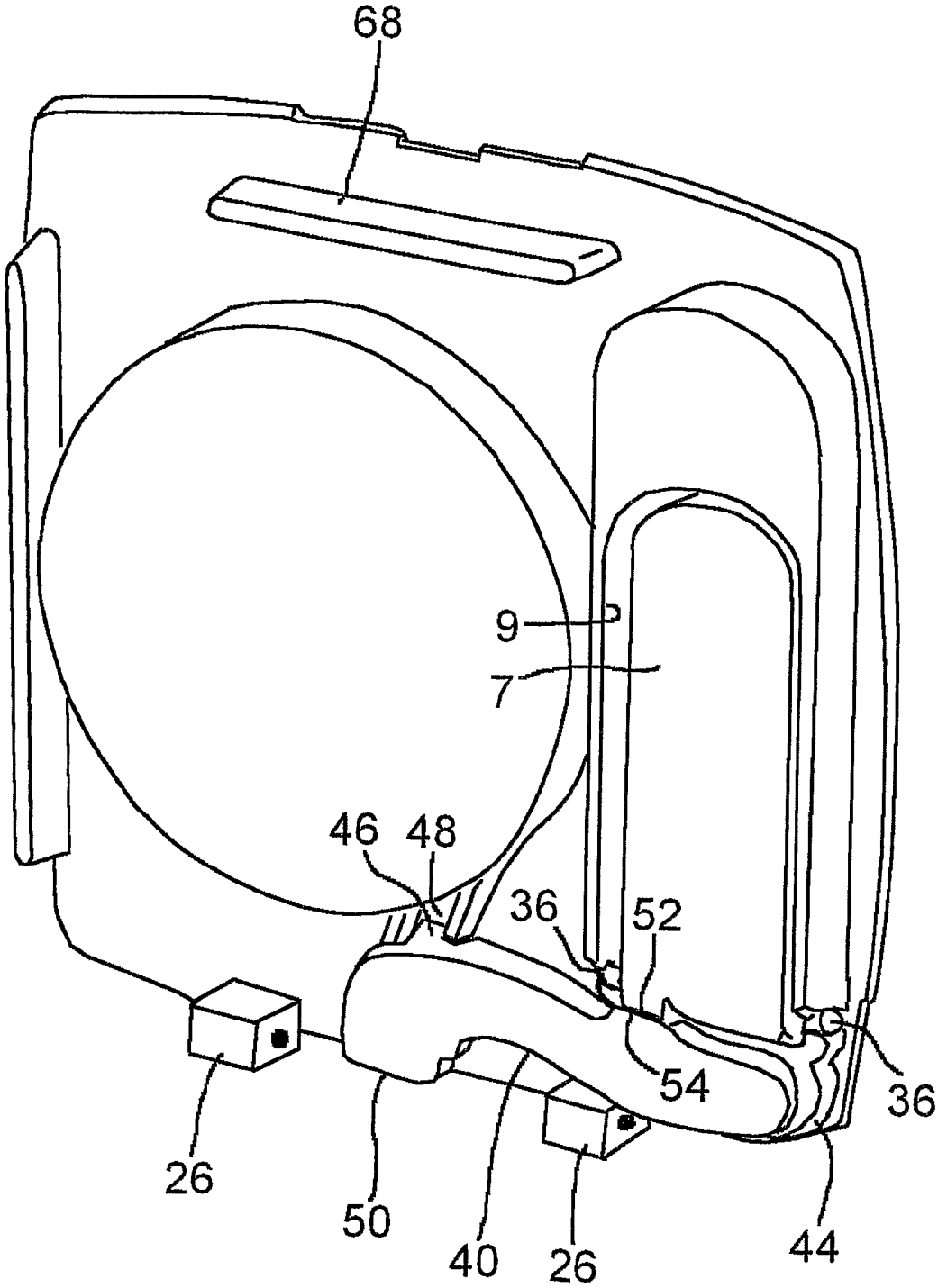
FIG. 8 is a perspective view from below of a base upper part of the compact of FIG. 6, assembled together with the holder and its operating lever.

The compact 30 shown in FIGS. 6-8 is similar to the previously described embodiment, except that the holder 7 pivots about an axis parallel to the lid hinge rather than about the lid hinge axis itself. The base 3 of the compact is again formed from upper 17 and lower 3*a* parts as best seen in FIGS. 6 and 7. The lid 2 is connected to the base upper part 17 by hinge pins 20, 22 which are press-fitted into holes in bosses 24, 26 integrally moulded with the base upper part 17. The pins extend into aligned holes formed in bosses 28, 32 integrally moulded with the lid 2. The bosses 28, 32 comprise a downward extension 34 of the lower rim of the lid 2.

The holder 7 is pivotally mounted to the base upper part 17 by a pair of trunnions 36, snap-fitted into respective bearing holes formed in the walls of the housing recess 9. A lever 40 is also pivotally mounted by an integrally moulded stub axle 42 which is received in a socket 44 moulded into the under surface of the upper part 17. A guide lug 46 at the opposite end of the lever from the stub axle 42 slides in an arcuate channel 48 formed on the upper part under surface.

With the lid 2, base lower part 3*a* and base upper part 17 assembled, a first actuating surface 50 on the lever 40 lies between the bosses 28, 32, in contact with the downward extension 34. When the lid is opened, the bosses 28, 32 and their downward extension 34 pivot about the pins 20, 22 and the downward extension 34 presses against the first actuating surface 50. This causes the lever to pivot about the socket 44 in a clockwise direction as shown in FIG. 8. This in turn causes a second actuating surface 52 on the lever 40 to press against a co-operating surface 54 formed on the rearward end of the holder 7. The holder 7 is thereby caused to pivot upwardly about the trunnions 36, to the position shown in FIG. 6 when the lid 2 is fully open. The bosses 28, 32 and the downward extension 34 are concealed in the compact base 3, beneath the upper surface of the base upper part 17, as is the lever 40.

The lid 2 is held closed by a latch 56 having a finger button 58 received in an aperture 62 formed in the rim of the base lower part 3*a*. The latch 56 has a tongue 60 with a thickened end 11 receivable in a recess 64 formed inside the rim of the lid 2, opposite to the hinge bosses 28, 32. The latch is biassed outwardly by an integrally moulded bowspring braced against a stop wall 68 moulded on the underside of the base upper part 17, or braced against suitable stops 69 moulded inside the base lower part 3*a*. Any other suitable latch may however be used to secure the lid closed.

Although in the embodiment just described, the holder 7 pivots about an axis parallel to that of the hinge, this need not be so. Mechanisms can readily be devised in which the hinge and holder pivot axes lie at any given desired angle to one another, up to and including 90 degrees.

The invention claimed is:

1. A cosmetics container comprising:

(a) a lid, (b) a base comprising at least a first recess for housing a holder when the cosmetics container is closed and at least a second recess sized and dimensioned for housing a cosmetics material, (c) a holder having an opening sized and dimensioned for holding a cosmetics applicator, and having a lift mechanism at its base end which causes the holder to lift from the first recess in the base when the cosmetics container is opened;

(d) a hinge interconnecting the lid and base, wherein the hinge comprises a boss positioned intermediate its ends, the boss comprising a step on its outer surface, and wherein the lift mechanism of the holder comprises a lip being engageable with the step of the boss, such that when the cosmetics container is opened, the lip on the lift mechanism engages with the step of the boss in order to lift the holder from the first recess in the base.

2. A cosmetics container as claimed in claim 1, in which the boss is attached to the lid.

3. A cosmetics container as claimed in claim 1, in which the boss of the hinge interdigitates with two further bosses positioned on the lift mechanism.

4. A cosmetics container as claimed in claim 1, in which the hinge comprises a boss on the lid, a boss on the base and a hinge pin through these bosses.

5. A cosmetics container as claimed in claim 4, in which the lid, base and holder are connected by the hinge pin.

6. A cosmetics container as claimed in claim 1, in which the lift mechanism further comprises a lever that operatively engages the holder.

7. A cosmetics container as claimed in claim 6, wherein the boss is fixed to the lid and the lever is pivotally mounted to the base.

8. A cosmetics container as claimed in claim 1, in which the holder for a cosmetics applicator is sized and dimensioned to receive a cosmetics brush.

9. A cosmetics container as claimed in claim 1, in which the boss lies in the base.

* * * * *